US005253734A

United States Patent [19]

Laurutis

[11] Patent Number: 5,253,734

[45] Date of Patent: Oct. 19, 1993

[54] HIGH RISE EMERGENCY ELEVATOR

[76] Inventor: Charles J. Laurutis, 808 W. 35th Pl., Yuma, Ariz. 85365

[21] Appl. No.: 850,171

[22] Filed: Mar. 11, 1992

[51] Int. Cl.[5] ..... B66B 9/02

[52] U.S. Cl. ..... 187/6; 187/7

[58] Field of Search ..... 187/2, 6, 7, 62, 48, 187/82, 142

[56] References Cited

U.S. PATENT DOCUMENTS

| | | | |
|---|---|---|---|
| 3,968,856 | 7/1976 | Keen et al. | 182/48 |
| 4,018,306 | 4/1977 | Lyons | 187/6 |
| 4,037,685 | 7/1977 | Tolucci | 182/48 X |
| 4,042,066 | 8/1977 | Noone | 187/6 |
| 4,121,689 | 10/1978 | Bonvin | 187/6 X |
| 4,162,717 | 7/1979 | Oru et al. | 182/48 |
| 4,167,224 | 9/1979 | Kinase et al. | 182/48 |
| 4,433,752 | 2/1984 | Günter | 187/6 X |
| 4,557,353 | 12/1985 | Pichon | 187/6 X |
| 4,640,384 | 2/1987 | Kucher et al. | 187/6 X |

OTHER PUBLICATIONS

Form No. 30-1B Champ Hoist Brochure, dated Feb. 1991.

*Primary Examiner*—Robert P. Olszewski
*Assistant Examiner*—Dean A. Reichard
*Attorney, Agent, or Firm*—Fulwider Patton Lee & Utecht

[57] ABSTRACT

An improved apparatus for providing access to the floors of a building during an emergency such as a fire, the apparatus including a structural support positioned on the exterior of a building and a transport system to transport persons or materials between the floors of the building along such support. The transport system includes a drive system for moving an elevator platform vertically along the support structure. An independent power source and the elevator platform are initially contained within a protective enclosure prior to their desired use. Other embodiments are also disclosed, including an adaption of the apparatus to buildings equipped with setbacks.

9 Claims, 3 Drawing Sheets

FIG. 1
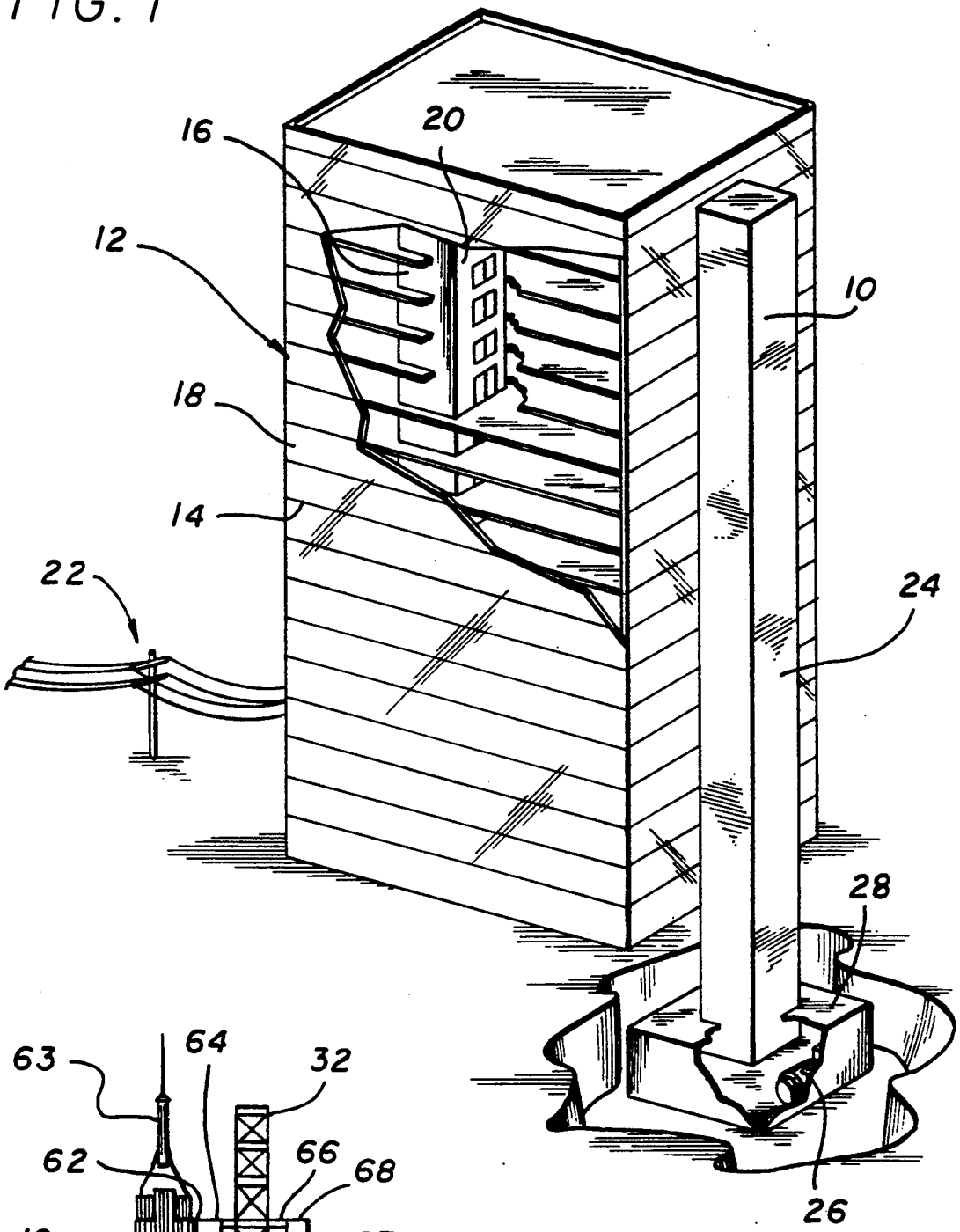
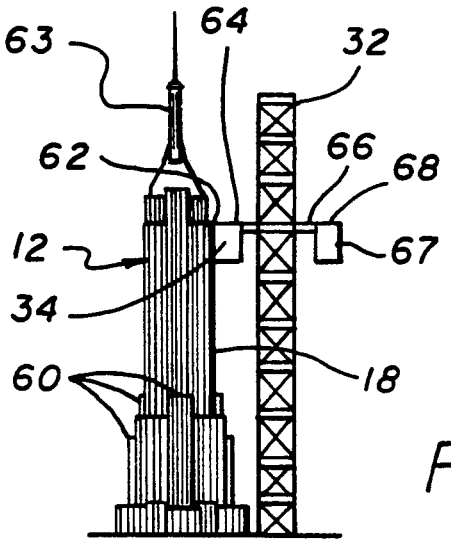
FIG. 4

FIG. 2
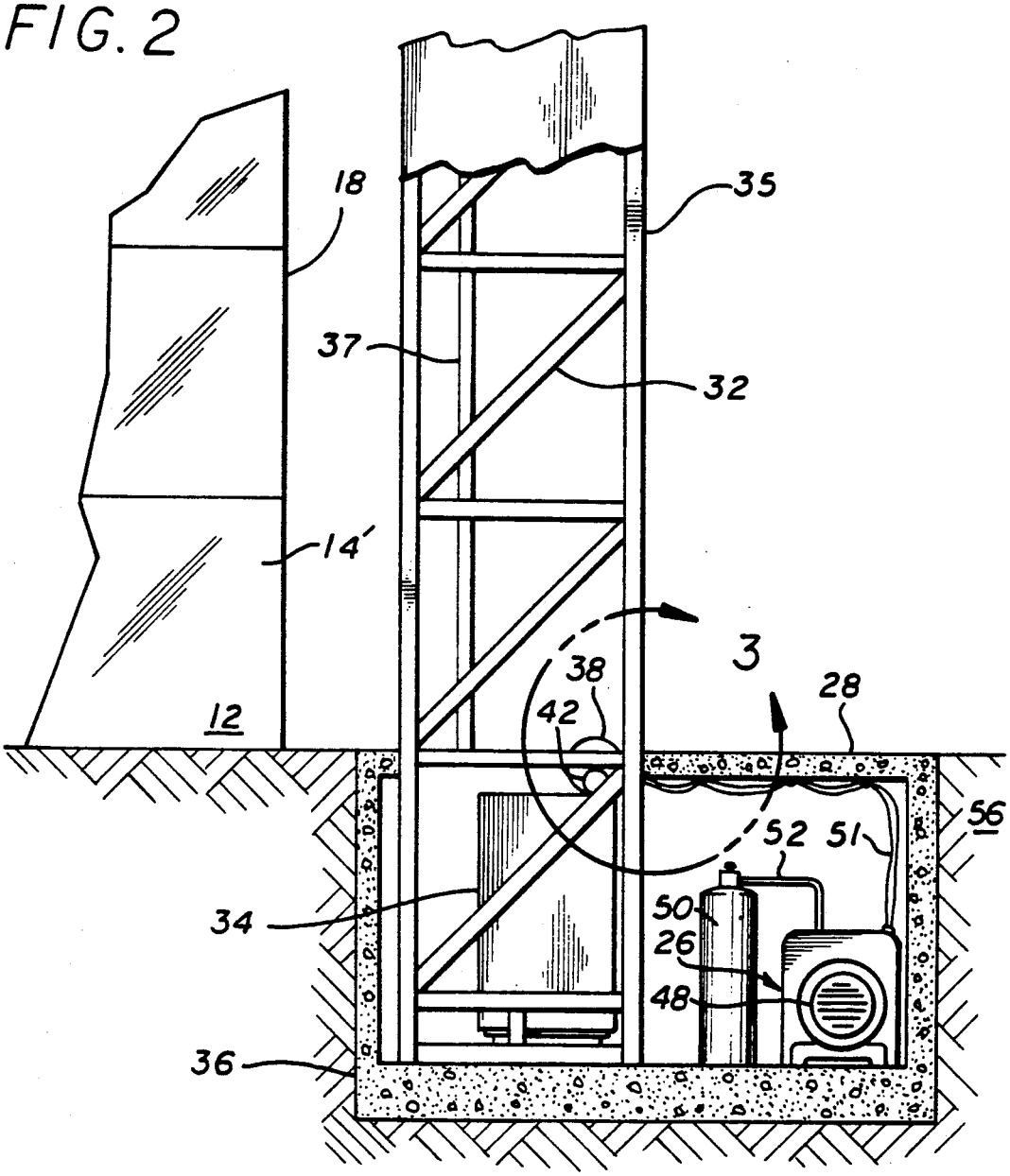
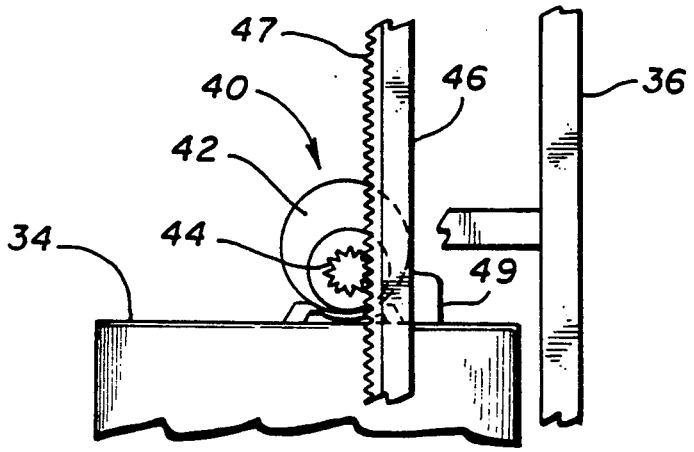
FIG. 3

HIGH RISE EMERGENCY ELEVATOR

FIELD OF INVENTION

The present invention relates generally to passenger elevator systems and, more specifically, to a new and improved apparatus for providing access to the floors of a building during an emergency such as a fire.

DESCRIPTION OF THE RELATED ART

It is common practice to provide elevators which can move between floors of a building. These elevators include cars which travel within an elevator shaft and the cars are generally connected to a counterweight by hoist cables, all of which are oriented vertically within the shaft. Movement to the desired floor is effected by motors, generally electrical, which depend upon the building's power source and are controlled by electrical systems within the building.

However, during catastrophes such as earthquakes or fires, the power within the building is often disrupted, and thus, conventional elevator service becomes unreliable. As a result, travel between floors during such an emergency is generally reduced to the use of stairs, ladders or articulated arms. If the floor involved is relatively high, or if there are floors above a fire, ladders and articulated arms may not be able to reach the desired floor from the exterior of the building.

Operating conventional elevators during a fire presents problems other than power loss. Air flow within an elevator shaft may act like an air tunnel, fanning the fire, spreading the fire from floor to floor, and destroying any otherwise operative elevator equipment within the elevator shaft. Fire fighting personnel, in the absence of elevator service, are required to hand carry any fire fighting equipment to the affected area which drastically reduces the amount of equipment that can be carried and the speed with which it can be deployed. One response to this problem has been to limit the area affected by fire through the use of a sprinkler system. Sprinklers strategically placed about the floors, triggered by a localized fire, usually limit the spread of the fire. However, sprinklers address only the need to fight the fires and do not provide a solution to the absence of elevator service. Evacuation from the upper floors of the building remains a problem. Furthermore, retrofitting buildings with sprinkler systems is both time-consuming and extremely expensive, sometimes exceeding the value of the building.

Thus, those who have been involved in the development of elevator systems and fire fighting have long recognized the need for an improved system which provides a reliable independent means to transport persons and materials to and from floors above the ground level of high rise buildings during emergencies. The present invention fulfills that need.

SUMMARY OF THE INVENTION

Briefly, and in general terms, the present invention provides a new and improved apparatus for transporting men and materials to higher floors of a high rise structure during catastrophes.

By way of example and not necessarily by way of limitation, the improved elevator system includes a transport system for vertically lifting men and materials between the floors of the building. An independent power source generates power which is not in any way connected to the building's power system so that in the event of a local power failure, the transport system can be activated and used. A protective environmental enclosure is sized to receive and shield the elevator platform and power generator from damage prior to the time of its intended use.

In one preferred embodiment, a generally vertical elevator support shaft is positioned adjacent to and spaced apart from the exterior of the building. An elevator platform, initially positioned within a protective environmental enclosure and including an independent power generator, is operatively engaged with the elevator support shaft through a drive system, such as a rack and pinion system or the like, to move vertically from a first protected position within the protective environmental enclosure to a second position adjacent a desired floor. A motor operatively engaged with the drive system is electrically connected with a self-contained generator to effect movement of the elevator platform along the elevator shaft in response to suitable controls associated with the elevator system.

In a currently preferred embodiment, the building is equipped with doors which provide access for the various floors of the building and the elevator is provided with a mating door which engages with the exterior of the building and allows access through the two doors from the elevator transport structure to the building. The building doors can be provided with locking systems which prevent opening unless accessed from the outside in order to prevent accidental opening from inside the building.

From the above, it can be readily seen that the present invention presents a new and useful apparatus for transporting men and materials to or from floors above the ground level of a building when a disaster has rendered the conventional elevator system unusable.

Other features and advantages of the present invention will become apparent from the following detailed description taken in conjunction with the accompanying drawings, which illustrate, by way of example, the principles of the invention.

DESCRIPTION OF THE DRAWINGS

FIG. 1 is a fragmentary, generally perspective drawing of the improved elevator system embodying features of the present invention;

FIG. 2 is a fragmentary side elevational view of the improved elevator system shown in FIG. 1;

FIG. 3 is an enlarged fragmentary side elevational view of the present invention taken substantially from the circle in FIG. 2;

FIG. 4 is a generally side elevational view of a preferred embodiment of the present invention.

DETAILED DESCRIPTION OF THE INVENTION

Figure 5:
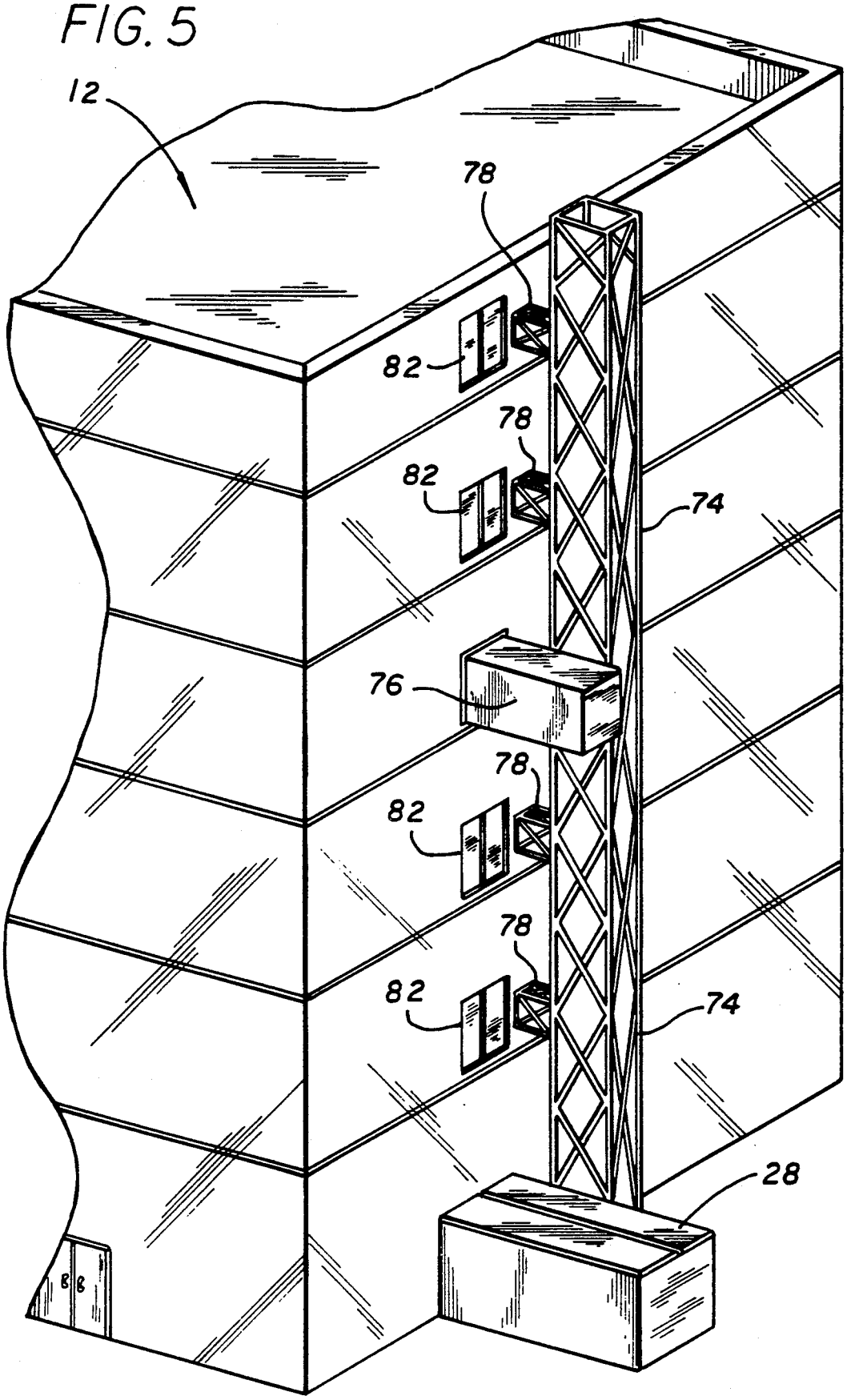
FIG. 5 is a fragmentary, generally perspective view of still another embodiment of the present invention.

As shown in the exemplary drawings, an improved elevator system 10, constructed in accordance with the present invention, allows ingress and egress from floors above ground level when conventional elevator systems dependent upon the building power supplies are rendered inoperative.

Referring to FIG. 1, there is shown the improved elevator system 10 of the present invention in combination with a building 12. The building 12 has a plurality of floors 14 generally above ground level. The building 12 has an interior 16 and an exterior 18. A first building elevator system 20 powered by a first power source 22 common with the buildings general power source, ordinarily provides for vertical travel between the floors 14 of the building 12.

The improved elevator system of the present invention includes a transport system for lifting materials vertically between the floors 14. An independent power generating system 26 is operatively connected to the transport system to provide power independently of a first power source 22. The independent power generating system enables the improved elevator system 10 to operate during periods of power outages resulting from fires, earthquakes or other catastrophes. Environmental enclosure receptacle 28 is positioned adjacent the building 12 and is sufficiently sized to protectively enclose the generating system 26 and a portion of the transport system 24 as is more fully described in this application.

As best shown in FIG. 2, the transport system 24 includes an elevator shaft 32 and an elevator platform 34. The elevator shaft 32 includes a frame or tower 35 extending upwards from a base 36. In a preferred embodiment, the elevator shaft 32 is spaced apart from about five to about ten feet from the closest point of the exterior 18 of the building 12 to thermally isolate the elevator shaft from the building, thus reducing the effect of a fire upon the elevator shaft 32. The shaft may be constructed as known to those skilled in the art. A dry stand pipe 37 extends vertically parallel to the elevator shaft 32 to provide additional cooling effect.

The elevator platform 34 may be in the form of an elevator car or cab engaged with, and for vertical movement along, the shaft 32. A platform 34 of the type conventionally used in the art is sufficient for the purposes of this invention. An example of such a platform is an elevator car of the type manufactured by Champ Equipment Co., Inc. of East Moline, Ill. The platform 34 is selectively moved vertically along the elevator shaft 32 by a drive system 38. The drive system 38 operatively engages the platform 34 with the elevator shaft 32 and allows selective vertical displacement of the platform from a first position within the enclosing receptacle 28 to a second position adjacent the desired above a ground level floor 14'.

As best shown in FIG. 3, in one particular embodiment, a rack and pinion drive system 40 is utilized. In that particular embodiment, an electric motor 42 mounted to the elevator platform 34 drives a pinion drive gear 44 which is meshed with or threadingly engaged with a rack 46, that is, a series of teeth 47 mounted or formed along the elevator shaft 32 or frame 36. Electromechanical braking system 49 provides additional braking of the platform 34 along shaft 32. Although the rack and pinion drive system shown is a preferred means to drive the elevator of the invention, other embodiments, including conventional hoist and counterweight systems well known to those skilled in the elevator art are also contemplated by the inventor.

Referring again to FIG. 2, independent power generator 26 is positioned, in this particular embodiment, within the protective environmental enclosure 28. The power generator 26, in the form of a propane gas/electrical generator 48, provides an independent source of power to drive the electric motor 42. Electrical connector 51 delivers the generator output to the electrical motor 42. A sealed container 50 of propane gas is fluidly connected through fuel connecting conduit 52 to provide a source of fuel for the generator 48. Of course, the particular generator and motor will vary with the size of elevator platform or car utilized. For example, a 100 to 250 Kilowatt generator may be sufficient for use in combination with twenty to forty passenger platforms or cars.

Protective environmental enclosure 28 is positioned adjacent the exterior 18 of the building 12. In a preferred embodiment the protective enclosure 28 is approximately sixteen feet long, by about eight feet wide, and about eight feet deep. The enclosure thus is sufficient to encompass the elevator platform 34 and power generating system 26 therein, and protecting the elevator platform 34 and the power generating system 26 from tampering and damage, also sealing the entrance to the improved elevator system from undesired entry by unauthorized persons. In one embodiment, as shown in FIG. 2 the enclosure may be set within a pit 56 such that the enclosure is generally below ground level. The inventor contemplates that the enclosure may be built above ground if desired.

Other embodiments of the transport system 24 may also include elements that compensate for lateral displacement of the exterior 18 of a building 12 when the exterior of the building is not entirely or wholly straight up and down. FIG. 4, for example, illustrates such an arrangement where the exterior of the building includes setbacks 60, observation decks 62 or a fastigated top 63. In this particular embodiment, elevator platform 34 is pivotally mounted to a first distal end 64 of an arm 66, which extends laterally from the elevator shaft 32. A counterweight 67 in this particular embodiment is pivotally mounted to a second distal end 68 substantially opposite to the first distal end 64. Arm 66 is moved vertically along elevator shaft 32 as described elsewhere in this application by drive system 38. By displacing arm 66 from a substantially horizontal position or an orientation substantially orthogonal to the longitudinal axis of the elevator shaft 32, the elevator platform 34 is guided from a first position relatively adjacent to the elevator shaft 32 to a second position spaced laterally apart therefrom to compensate for the lateral displacement of the exterior 18 of the building 12.

In a second preferred embodiment illustrated in FIG. 5, an external support structure 74 is used to support the elevator 76. Structure 74 thus provides an external support structure, rather than a shaft 32 as illustrated in FIG. 2, and is less obtrusive and more economical to build than the shaft structure of FIG. 2. In operation, it is also possible to provide structure 74 with stand-off structures 78 which are attached to the building 12 and thereby provide additional support so that a relatively small structure 74 can be used. However, such construction must be balanced against the possibility of damage to the building from the disaster that creates the need to use the emergency elevator. Accordingly, decisions of whether to use a self-supporting shaft or a shaft structurally affaced to the building are dependent on the basic structural integrity of the building and external access available to the internal structure of the building. FIG. 5 also illustrates fire doors 82 on the exterior 18 of the building 12 which may be used to engagingly mate with the elevator door in order to provide secure access to the building 12 from elevator 76 after it is removed from environmental enclosure 28. In a preferred embodiment, the fire doors 82 are equipped with locking devices which prevent opening of the doors except from the outside. Elevator platform 76 can also be equipped with a mating door which engages and locks with fire door 82 to provide secure access to the floor of the building from the elevator.

In operation, the environmental enclosure 28 is opened when it is desired that transport be effected to an above ground level floor when the conventional elevators 20 are not operational. The connecting conduit 52 is opened and the independent power generator 48 provides power to the electric motor 42. The elevator platform 34 is moved from a first position within the protective enclosing receptacle 28 to a second position adjacent a desired level or floor 14 of the building 12. Although the protective enclosure is shown in a below-ground position, those in the construction arts will appreciate that a suitable enclosure also can be constructed in an above-ground position, even to the point of being part way up the building to minimize the possibility of water damage or vandalism.

It will be appreciated from the foregoing that the present invention represents a significant advance in the field of building safety. In particular, the present invention provides a means for the rapid and effective vertical transport of persons and materials to floors above ground level when the interior elevator systems for the building have failed. Those skilled in the art will also appreciate that the present invention represents a highly cost-effective and rapid means of fighting a high-rise fire when compared with the costs of retrofitted sprinkler systems and the like. It will also be appreciated that, although the presently preferred embodiments of the invention have been described by way of example, various modifications may be made without departing from the spirit and scope of the invention. Accordingly, the present invention is not intended to be limited except as by the appended claims.

What is claimed is:

1. An apparatus for vertical transportation between the floors of a building during an emergency, said building having a plurality of floors, a first power supply, an interior and an exterior, said apparatus comprising:

structural support means permanently positioned on said exterior of said building;

transport means for transporting persons and materials between said floors along said structural support means;

generating means for providing power for said transport means independent of said first power supply, said generating means electrically connected to said transport means; and a single environmental enclosure for protecting both an elevator car and said generating means from damage to environmental effects prior to their use.

2. An apparatus as set forth in claim 1 wherein said transport means includes an elevator platform, said structural support means positioned adjacent said exterior of said building and said elevator platform positioned to move from a first position within said environmental enclosure means to a second position adjacent a floor of said building.

3. An apparatus as set forth in claim 1 wherein said structural support means further comprises means to guide said transport means between building exterior walls that are laterally displaced from one another.

4. An elevator system for vertical transport between the floors of a building during an emergency, said building having an interior and an exterior, said elevator system comprising:

an elevator shaft, said shaft permanently spaced apart from said exterior of said building;

an elevator platform for transport along said elevator shaft;

drive means for moving said platform along said elevator shaft, said drive means engaging said elevator shaft with said elevator platform;

independent generating means for providing power to move said elevator platform along said elevator shaft, said generating means connected to said drive means for moving said platform; and environmental enclosure means, both said elevator platform and said independent generating means being received within said enclosure means, said elevator shaft extending from a position adjacent said enclosure means.

5. An elevator system for vertical transport between the floors of a building as set forth in claim 4, wherein said transporting means includes an electrical motor, a pinion and a rack, said electrical motor mounted to said platform, said pinion engaged with said motor, said rack mounted to said elevator shaft and engaged with said pinion.

6. An elevator system for vertical transport between the floors of a building as set forth in claim 4, wherein said independent power generating means includes an electrical generator which converts the burning of propane gas into electrical power, and a propane gas source, said gas source fluidly connected to said electrical generator.

7. An elevator system for use in combination with a multi-storied building for vertical transport between the floors of said building during an emergency, said building having an exterior and an interior, said elevator system comprising:

an elevator shaft, said shaft permanently spaced apart from the exterior of a building a sufficient distance to thermally isolate said shaft from said building;

an elevator platform for transporting men and materials vertically along said elevator shaft;

drive means for moving said platform along said elevator shaft, said drive means engaging said elevator shaft with said elevator platform;

a motor engaged with said drive means;

independent generating means for providing power to said motor, said generating means electrically connected to said motor;

environmental enclosure means for protective receipt of said generating means therein, both said elevator platform and said independent generating means being received within said enclosure means, said elevator shaft extending from adjacent said enclosure means.

8. An apparatus as set forth in claim 7, further including a dry stand pipe positioned adjacent said elevator shaft.

9. An apparatus as set forth in claim 7, further comprising fire doors for each floor of a building to which access is to be provided; and means to matingly engage said fire doors from said platform.

* * * * *

UNITED STATES PATENT AND TRADEMARK OFFICE

CERTIFICATE OF CORRECTION

PATENT NO. : 5,253,734

DATED : October 19, 1993

INVENTOR(S) : Charles J. Laurutis

It is certified that error appears in the above-indentified patent and that said Letters Patent is hereby corrected as shown below:

In claim 1, Column 5, Line 51, insert "due" after "damage".

Signed and Sealed this

Thirtieth Day of August, 1994

*Attest:*

*Attesting Officer*

Bruce Lehman

BRUCE LEHMAN

*Commissioner of Patents and Trademarks*